US009533692B2

(12) United States Patent
Hirashima et al.

(10) Patent No.: US 9,533,692 B2
(45) Date of Patent: Jan. 3, 2017

(54) FLOOR STRUCTURE OF RAILCAR AND RAILCAR INCLUDING SAME

(71) Applicant: KAWASAKI JUKOGYO KABUSHIKI KAISHA, Kobe-shi, Hyogo (JP)

(72) Inventors: Toshiyuki Hirashima, Kobe (JP); Eiichi Kato, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 160 days.

(21) Appl. No.: 14/387,860

(22) PCT Filed: Mar. 21, 2013

(86) PCT No.: PCT/JP2013/001935
§ 371 (c)(1),
(2) Date: Dec. 1, 2014

(87) PCT Pub. No.: WO2013/145660
PCT Pub. Date: Oct. 3, 2013

(65) Prior Publication Data

US 2015/0367863 A1 Dec. 24, 2015

(30) Foreign Application Priority Data

Mar. 28, 2012 (JP) ..... 2012-073544

(51) Int. Cl.
*B61D 17/00* (2006.01)
*B61D 17/10* (2006.01)
(Continued)

(52) U.S. Cl.
CPC ..... *B61D 17/10* (2013.01); *B61D 1/00* (2013.01); *B61D 17/08* (2013.01)

(58) Field of Classification Search
CPC ..... B61F 1/10; B61D 1/00; B61D 17/08; B61D 17/10
(Continued)

(56) References Cited

U.S. PATENT DOCUMENTS 2,294,357 A * 8/1942 Dean ..... B61D 17/046 105/396
2,331,891 A * 10/1943 Dean ..... B61F 1/10 105/414
(Continued)

FOREIGN PATENT DOCUMENTS

DE 2910755 C2 2/1985
JP U-57-113265 7/1982
(Continued)

OTHER PUBLICATIONS

Jan. 26, 2015 Office Action issued in Taiwanese Patent Application No. 102110447 with English Translation of Search Report.
(Continued)

*Primary Examiner* — Jason C Smith
(74) *Attorney, Agent, or Firm* — Oliff PLC

(57) ABSTRACT

A floor structure of a railcar includes: a pair of side sills extending in a railcar longitudinal direction; cross beams extending in a railcar width direction and coupling the pair of side sills; a supporting member, which is arranged on upper surfaces of the cross beams, in which bottom surface portions and convex portions projecting upward from the bottom surface portions are alternately, continuously formed in the railcar width direction, and which extends in the railcar longitudinal direction; receiving members located at positions corresponding to the cross beams, arranged on an upper surface of the supporting member, and extending in the railcar width direction; and a floor panel arranged on upper surfaces of the receiving members. The receiving members include: a floor plate contact portion that contacts
(Continued)

the floor panel; and leg portions, extending from the floor plate contact portion to the bottom surface portion of the supporting member.

8 Claims, 4 Drawing Sheets

(51) Int. Cl.
*B61D 1/00* (2006.01)
*B61D 17/08* (2006.01)

(58) Field of Classification Search
USPC ..... 105/413, 421, 422
See application file for complete search history.

(56) References Cited

U.S. PATENT DOCUMENTS 2,504,112 A * 4/1950 Dean ..... B61F 1/10 105/414
2,589,996 A * 3/1952 Dean ..... B61F 1/10 105/420
2,646,009 A * 7/1953 Dean ..... B61F 1/10 105/420
2,946,297 A * 7/1960 Dean ..... B61D 1/00 105/345
4,645,258 A * 2/1987 Ohmura ..... B62D 25/2054 105/422
4,794,032 A * 12/1988 Fujii ..... B61D 17/10 105/396
4,966,082 A * 10/1990 Takeichi ..... E04B 1/34336 105/422
5,287,814 A * 2/1994 Masai ..... B61D 17/04 105/418
5,918,549 A * 7/1999 Basile ..... B61D 17/10 105/422
6,000,342 A * 12/1999 Thoman ..... B61D 17/04 105/404
6,722,288 B2 * 4/2004 Beers ..... B61F 1/02 105/413
8,530,782 B2 * 9/2013 Komaki ..... B23K 26/22 105/396
2004/0145215 A1 * 7/2004 Taguchi ..... B61D 17/08 296/187.02
2015/0047530 A1 * 2/2015 Hirashima ..... B61D 17/10 105/413
2015/0291185 A1 * 10/2015 Hirashima ..... B61D 17/08 105/418
2015/0367863 A1 * 12/2015 Hirashima ..... B61D 17/10 105/422

FOREIGN PATENT DOCUMENTS

JP U-59-131359 9/1984
JP U-06-044668 6/1994

OTHER PUBLICATIONS

Oct. 8, 2014 Office Action issued in Korean Application No. 10-2014-7020327 (with English translation.).

Jun. 25, 2013 International Search Report issued in International Application No. PCT/JP2013/001935.

* cited by examiner

FLOOR STRUCTURE OF RAILCAR AND RAILCAR INCLUDING SAME

TECHNICAL FIELD

The present invention relates to a floor structure of a railcar and a railcar including the floor structure.

BACKGROUND ART

Conventionally known as a floor structure of a railcar is a structure (hereinafter referred to as a "sub-floor structure") in which: a floor pan having a concave cross section is arranged between cross beams of an underframe; and a heat insulating material or the like is provided inside the floor pan. Further, proposed is a floor structure (for example, PTL 1) in which: a corrugated plate and a floor receiver are arranged in the underframe; and a heat and sound insulating material is provided between the corrugated plate and the floor plate.

According to the floor structure of PTL 1, since the corrugated plate is arranged at a position lower than upper surfaces of the cross beams and higher than a lower surface of the underframe, a buckling strength of the floor structure can be improved, and the upper surface of the floor can be lowered.

CITATION LIST

Patent Literature

PTL 1: Japanese Examined Utility Model Application Publication No. 59-131359

SUMMARY OF INVENTION

Technical Problem

The conventional sub-floor structure does not contribute to the improvement of the strength of the railcar. Therefore, there is a problem that in a case where torsional deformation of a bodyshell is caused, respective portions of the bodyshell need to be reinforced in order to secure the stiffness of the bodyshell, and this increases the complexity of the structure. Further, the sub-floor structure has a problem that since the floor pan is produced by press forming or roll forming, and this requires a mold, the cost increases. Especially in a case where an arrangement pitch of the cross beams needs to be changed due to the arrangement of underfloor devices, a plurality of molds are required, so that the cost further increases.

According to the floor structure of PLT 1, since the corrugated plate is arranged inside the underframe, the height of the upper surface of the floor can be lowered. However, there is a problem that since the floor receiver that supports the floor plate extends in a railcar longitudinal direction and is placed on a convex portion of the corrugated plate, the floor receiver cannot adequately support passenger loads. The present invention was made to solve the above problems, and an object of the present invention is to provide a floor structure of a railcar, the floor structure being capable of securing its stiffness by a simple configuration, and a railcar including the floor structure.

Solution to Problem

A floor structure of a railcar according to an aspect of the present invention includes: a pair of side sills extending in a railcar longitudinal direction; a plurality of cross beams extending in a railcar width direction and coupling the pair of side sills; a supporting member, which is at arranged on upper surfaces of the cross beams, in which bottom surface portions and convex portions projecting upward from the bottom surface portions are alternately, continuously formed in the railcar width direction, and which extends in the railcar longitudinal direction receiving members respectively located at positions corresponding to the cross beams, arranged on an upper surface of the supporting member, and extending in the railcar width direction; and as floor panel arranged on upper surfaces of the receiving members, wherein each of the receiving members includes: a floor plate contact portion that contacts the floor panel; and leg portions, each of which extends from the floor plate contact portion to the bottom surface portion of the supporting member.

According to this configuration, the receiving members that support passenger loads are provided on the supporting member located on upper surfaces of the cross beams, and the leg portions of the receiving members are respectively arranged at the bottom surface portions of the supporting member. Therefore, the adequate stiffness of the floor structure can be secured by the simple configuration.

Advantageous Effects of Invention

According to the floor structure of the railcar described above, the floor structure capable of securing the stillness by the simple configuration and the railcar including the floor structure can be provided.

DESCRIPTION OF EMBODIMENTS

Hereinafter, embodiments will be explained in reference to the drawings. In the following explanations and drawings, the same reference signs are used fix the same or corresponding components, and a repetition of the same explanation is avoided.

Embodiment 1

Figure 1:
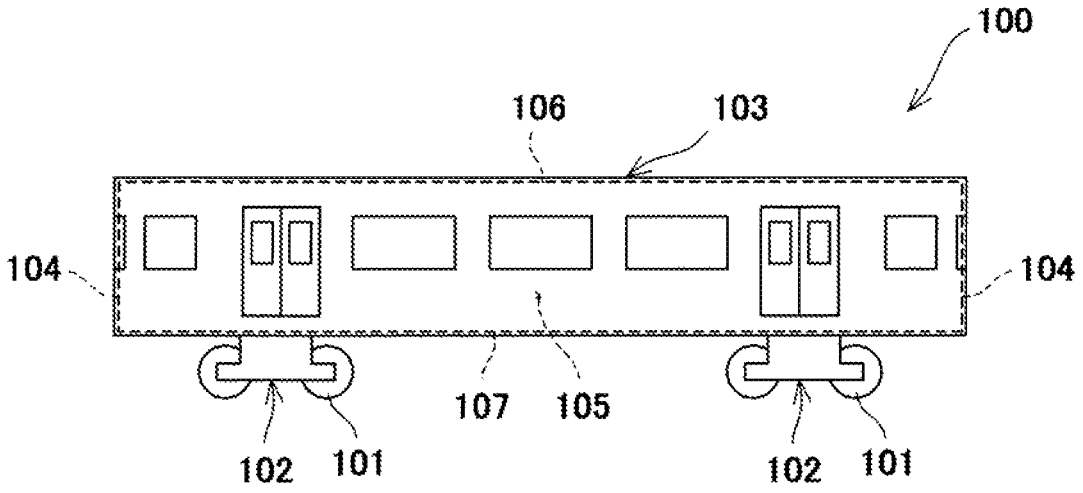
FIG. 1 is a schematic side view of a railcar according to one embodiment.

First, a railcar 100 according to Embodiment 1 will be explained in reference to FIGS. 1 to 3. FIG. 1 is a schematic side view of the railcar 100 according to the present embodiment. A left-right direction on the sheet of FIG. 1 corresponds to a longitudinal direction of the railcar 100, and a direction toward the sheet of FIG. 1 corresponds to a width direction of the railcar 100. In the following explanations, the longitudinal direction a the railcar 100 is simply referred to as a "railcar longitudinal direction", and the width direction of the railcar 100 is simply referred to as a "railcar width direction".

As shown in FIG. 1, the railcar 100 includes bogies 102 and a carbody 103 provided on the bogies 102. The carbody 103 is made of for example, stainless steel and includes: end bodyshells 104 that are end panels; side bodyshells 105 that are side surfaces; a roof bodyshell 106 that is a roof; and an underframe (floor bodyshell) 107 that is a floor portion. A below-described corrugated plate 30 is fixed to an upper surface of the underframe 107 (see FIG. 2).

Figure 2:
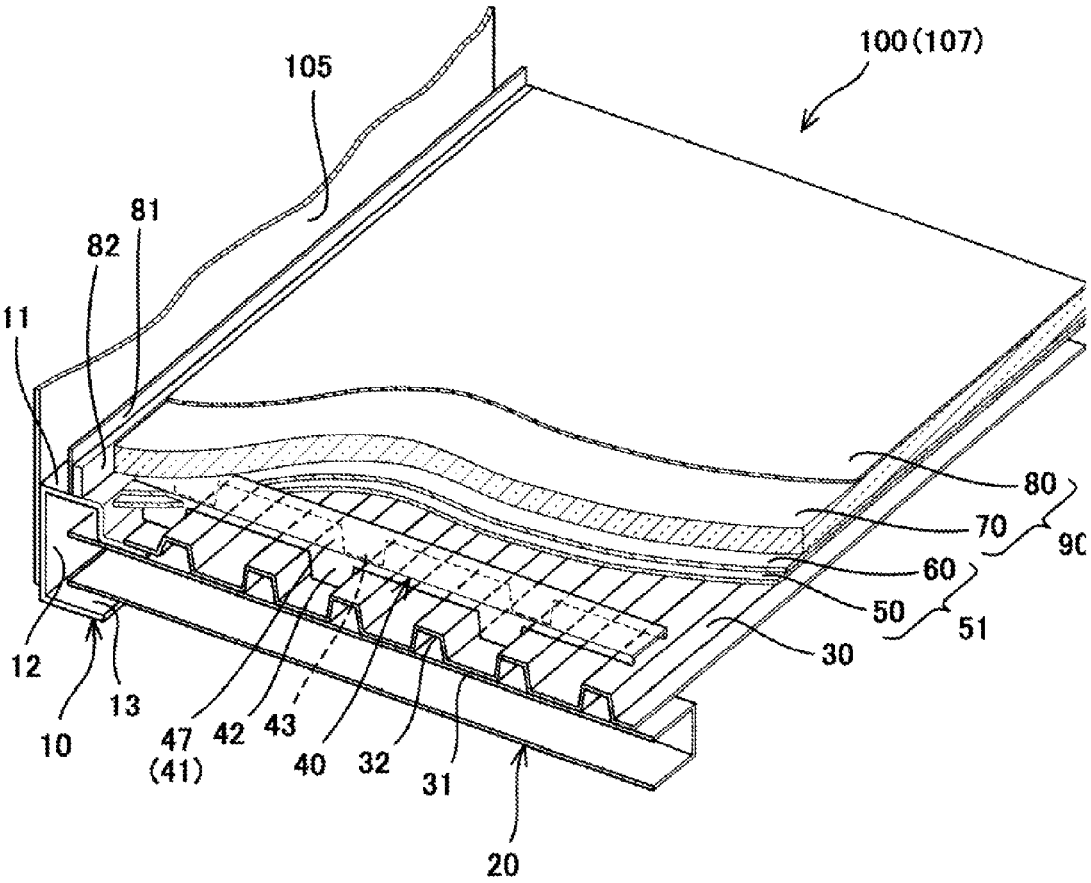
FIG. 2 is a cross-sectional perspective view of a floor portion (underframe) of the railcar shown in FIG. 1.

FIG. 2 is a partially perspective cross-sectional view of the floor portion of the railcar 100. In the following explanations, a left near side on the sheet of FIG. 2 is referred to as to front side in the railcar longitudinal direction, and a right far side on the sheet of FIG. 2 is referred to a rear side in the railcar longitudinal direction. As shown in FIG. 2, the railcar 100 includes: side sills 10; cross beams 20; the corrugated plate 30 corresponding to a supporting member; receiving members 40; a heat absorbing layer 50; a heat dispersing layer 60; and a floor panel 90 including a floor plate 70 and a surface sheet 80. Hereinafter, these components will be explained in order.

The side sills 10 are members respectively located at railcar-width-direction end portions of the railcar 100. The side sills 10 are respectively located at both railcar-width-direction end portions of the railcar 100, form a pair, and extend in the railcar longitudinal direction. FIG. 3 is a partial cross-sectional view of the floor portion of the railcar 100. In FIG. 3, a part of the receiving member 40 is shown so as to overlap the floor portion. As shown in FIG. 3, the side sill 10 has a shape that is open toward an inner side in the railcar width direction. The side sill 10 is mainly constituted by: an upper surface portion 11 located at an upper surface side; a side surface portion 12 coupled, to the upper surface portion 11 and opposed to end surfaces of the cross beams 20; and as lower surface portion 13 coupled to the side surface portion 12 and opposed to the upper surface portion 11. The upper surface portion 11 includes: an upper stage portion 14 located at an outer side in the railcar width direction; and a lower stage portion 15 formed continuously with the upper stage portion 14 and located at a lower side of the upper stage portion 14 and an inner side of the upper stage portion 14 in the railcar width direction. In the present embodiment, the upper stage portion 14 and the lower stage portion 15 are integrally formed. However, there may be a case where the lower stage portion 15 of the side sill 10 is formed separately from the other portions of the side sill 10, and these portions are coupled to one another.

Each of the cross beams 20 extends in the railcar width direction and couples the side sills 10 respectively located at both railcar-width-direction sides. The cross beams 20 are respectively arranged at a plurality of positions of the underframe 107 so as to be spaced apart from one another in the railcar longitudinal direction. As shown in FIG. 2, the cross beam 20 of the present embodiment has a C-shaped cross section. As shown in FIG. 3, a railcar-width-direction end portion of the cross beam 20 is located inside the side sill 10. A lower surface of the cross beam 20 and an upper surface of the lower surface portion 13 of the side sill 10 contact each other to be fixed to each other, and an upper surface of the cross beam 20 and a lower surface of the lower stage portion 15 of the side sill 10 contact each other to be fixed to each other.

The corrugated plate 30 is a plate member fixed to an upper surface of the underframe 107 (that is, the side sill 10 and the cross beam 20). The corrugated plate 30 is made of for example, stainless steel. As shown in FIG. 2, the corrugated plate 30 has a corrugated structure in which bottom surface portions 31 that are bottom portions and convex portions 32 projecting upward from the bottom surface portions 31 are alternately, continuously formed in the railcar width direction. The bottom surface portion 31 and the convex portion 32 are parallel to each other and extend in the railcar longitudinal direction. Other than the corrugated plate having the shape shown in FIG. 2, the corrupted plate may be a so-called keystone plate having a keystone structure in which as distance between the adjacent convex portions 32 increases as the convex portions 32 extend downward.

Figure 3:
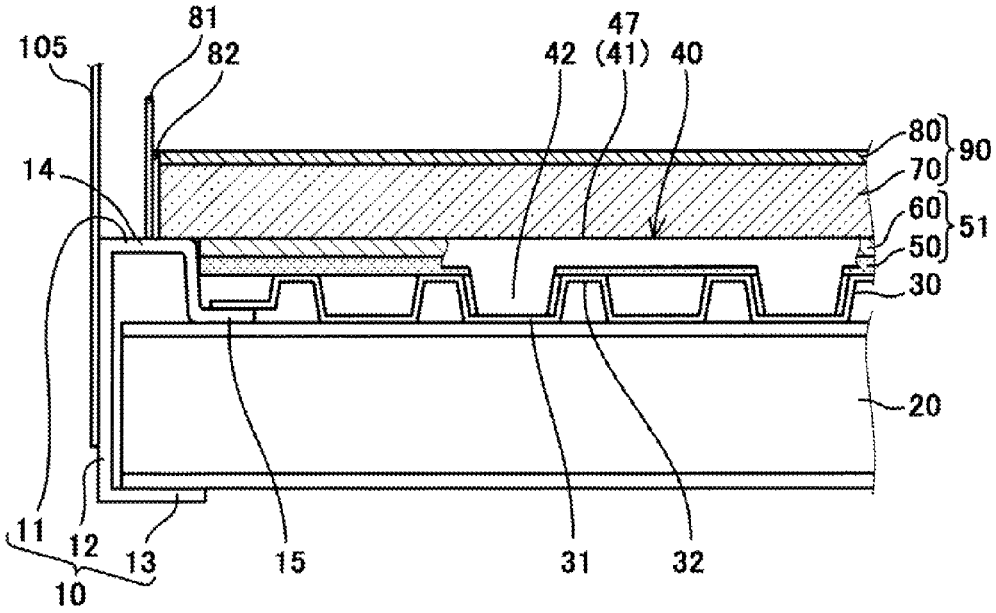
FIG. 3 is to partial cross-sectional view of the floor portion (underframe) shown in FIG. 2.

As shown in FIG. 3, a lower surface, of the bottom surface portion 31 of the railcar-width-direction end portion of the corrugated plate 30 and an upper surface of the lower stage portion 15 of the side sill 10 contact each other to be fixed to each other. Further, the lower surface of the bottom surface portion 31 other than the bottom surface portion 34 of the railcar-width-direction end portion of the corrugated plate 30 and the upper surface of the cross beam 20 contact each other to be fixed to each other. An upper surface of the convex portion 32 of the corrugated plate 30 is located lower than an upper surface of the upper stage portion 14 of the side sill 10. As above, the lower stage portion 15 with which the lower surface of the bottom surface portion 31 of the corrugated plate 30 contacts is located lower than the upper stage portion 14 of the side sill 10. Therefore, the corrugated plate 30 can be arranged at a comparatively low position while maintaining the height of the side sill 10. In addition, according to the above configuration of the side sill 10, a space between the corrugated plate 30 and an upper surface of the floor panel 90 can be secured while securing the heights of a bolster beam and an end beam, which are important in tens of the strength. With this, a thin type floor structure can be realized, so that the position of the floor surface can be lowered, and a large railcar inner space can be secured.

The receiving members 40 are members that extend in the railcar width direction and support the floor panel 90. The receiving members 40 are made of for example, stainless steel. The receiving members 40 are arranged so as to respectively correspond to the positions of the cross beams 20 (that is, be respectively arranged above the cross beams 20). Further, the receiving member 40 includes a floor plate contact portion 47 corresponding to an upper surface portion thereof. The floor plate contact portion 47 includes a floor plate contact surface 41 that contacts a lower surface of the floor plate 70. As shown in FIG. 3, the floor plate contact surface 41 is located higher than the upper surfaces of the convex portions 32 of the corrugated plate 30 and is substantially the same in height as the upper surface of the upper stage portion 14 of the side sill 10. With this, the floor plate 70 can be directly placed on the receiving member 40 and the side sill 10 without providing an additional member. Therefore, the height of the upper surface of the floor panel 90 can be easily flattened with a high degree of accuracy, and the flatness of the floor panel 90 can be uniformized. A railcar-width-direction end portion of the receiving member 40 is placed on the lower stage portion 15 of the side sill 10 via the corrugated plate 30.

Further, the receiving member 40 includes leg portions extending from a railcar-longitudinal-direction front end of the floor plate contact surface 41 to the bottom surface portions 31 of the corrugated plate 30. The leg portions include: a plurality of front leg portions 42 corresponding to first leg portions; and a plurality of rear leg portions 43 (see FIG. 2) corresponding to second leg portions and extending from a railcar-longitudinal-direction rear end of the floor plate contact surface to the bottom surface portions 31 of the corrugated plate 30. A lower end of the front leg portion 42 and the bottom surface portion 31 are fixed to each other by fillet welding, and a lower end of the rear leg portion 43 and the bottom surface portion 31 are fixed to each other by fillet welding. As above, the front leg portions 42 and the rear leg portions 41 are provided so as to correspond to the bottom surface portions 31. However, the front leg portions 42 and the rear leg portions 43 do not correspond to all the bottom surface portions 31. In order to reduce the weight, the front leg portions 42 and the rear leg portions 43 are provided so as to correspond to alternate bottom surface portions 31 in the railcar width dimension. At a position where the receiving member 40 is arranged, the receiving member 40 and the convex portion 32 of the corrugated plate 30 are spaced apart from each other. Therefore, force, such as the passenger loads, are applied from the leg portions to the cross beams 20 via the bottom surface portions 31. Thus, the loads acting on the corrugated plate 30 can be reduced.

The heat absorbing layer 50 is a layer that absorbs heat. The heat absorbing layer 5 and the below-described heat dispersing layer 60 constitute a stack member 51. As shown in FIG. 3, the heat absorbing layer 50 is stacked on an upper surface of the corrugated plate 30. The heat absorbing layer 50 is limited such that a heat absorbing material is dispersed inside ceramic wool. In the present embodiment, used as the heat absorbing material is vermiculite that is a heat expansion material. As the heat absorbing material (vermiculite) expands with heat, the entire heat absorbing layer 50 of the present embodiment also expands. The heat absorbing material used in the heat absorbing layer 50 may be a material other than the vermiculite. It is desirable that a heat absorption start temperature of the heat absorbing material be 350° C. to 550° C. This is because if the heat absorbing material starts absorbing heat at a too low temperature, it cannot adequately achieve its function. For example, a heat-resistant heat-insulating material M20A produced by Sumitomo 3M Ltd. can be used as the heat absorbing layer 50.

The heat dispersing layer 60 is a layer that disperses heat in a surface direction. The heat dispersing layer 60 and the heat absorbing layer 50 constitute the stack member 51. As shown in FIG. 3, the heat dispersing layer 60 is stacked on an upper surface of the heat absorbing layer 50. The heat dispersing layer 60 is constituted by a heat insulating material. The heat insulating material constituting the heat dispersing layer 60 is not especially limited, and glass wool, ceramic wool, or the like may be used. Since the heat disposing layer 60 is constituted by the heat insulating material as described above, the hem disposing layer 60 has not only an effect of dispersing heat but also a heat insulating effect. A difference, between the "heat absorbing material" contained in the heat absorbing layer 50 and the "heat insulating material" firming the heat dispersing layer 60 will be simply explained below. That is, the heat absorbing material is a material that per an endothermic reaction of absorbing heat whereas the heat insulating material does not absorb heat and is just a material to which heat is hardly conducted. An elastic modulus of the stack member 51 constituted by the heat absorbing layer 50 and the heat dispersing layer 60 is smaller than that of each of the floor panel 90 and the receiving member 40.

The floor plate 70 is a member configured to secure the stiffness of the floor portion and is a so-called base material. The floor plan 70 according to the present embodiment is formed by a foamed synthetic resin material. The floor plate 70 is located at an upper side of the heat dispersing layer 60, and the thickness of the door plate 70 is the largest among the members stacked on the corrugated plate 30. The material that forms the floor plate 70 is not limited to the foamed synthetic resin material. Instead of this, a known material such its wood or a light-alloy honeycomb material, used in the floor panel may be used as the material, of the floor plate 70. A railcar-width-direction end portion of the floor plate 70 is mounted on the upper stage portion 14 of the side sill 10. Then, a portion of the floor plate 70 other than the railcar-width-direction end portion is supported by the receiving members 40. Since the floor plate 70 is supported by the receiving members 40 as above, the floor plate 70 is stably supported. To be specific, in a case where the floor plate 70 is directly placed on the stack member 51 (the heat absorbing layer 50 and the heat dispersing layer 60) that is soft (that has the small elastic modulus) without using the receiving members 40, the floor plate 70 may become unstable, and the flatness of the floor panel 90 may not be able to be maintained. This can be prevented by using the receiving members 40.

The surface sheet 80 is a laid member that is laid on an upper surface of the floor plate 70. The surface sheet 80 is, for example, a rubber sheet and can reduce the impact generated, for example. when passengers walk. In addition, the surface sheet 80 prevents noises and vibrations, generated from devices arranged under the floor, from being transferred to the passenger room. The surface sheet 80 is not limited to the rubber sheet. Instead of this, a laid member, such as a vinyl chloride resin sheet an define resin sheet, or a carpet, typically used in railcars can be used as the surface sheet 80. As shown in FIG. 3, a vertical plate-shaped dividing member 81 is fixed to the upper surface portion 11 of the side sill 10, and a sealing member 82 is inserted between the dividing member 81 and the floor plate 70 and between the dividing member 81 and the surface sheet 80. With this, water-tightness between the upper surface of the floor panel 90 and the underframe 107 can be secured.

Embodiment 2

Figure 4:
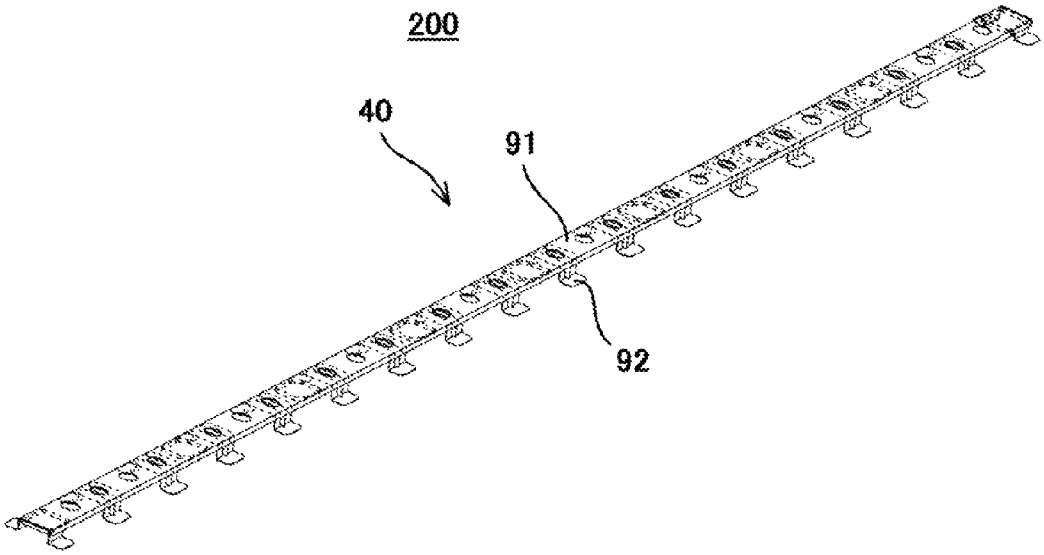
FIG. 4 is a perspective view of a supporting member according to another embodiment.
Figure 5:
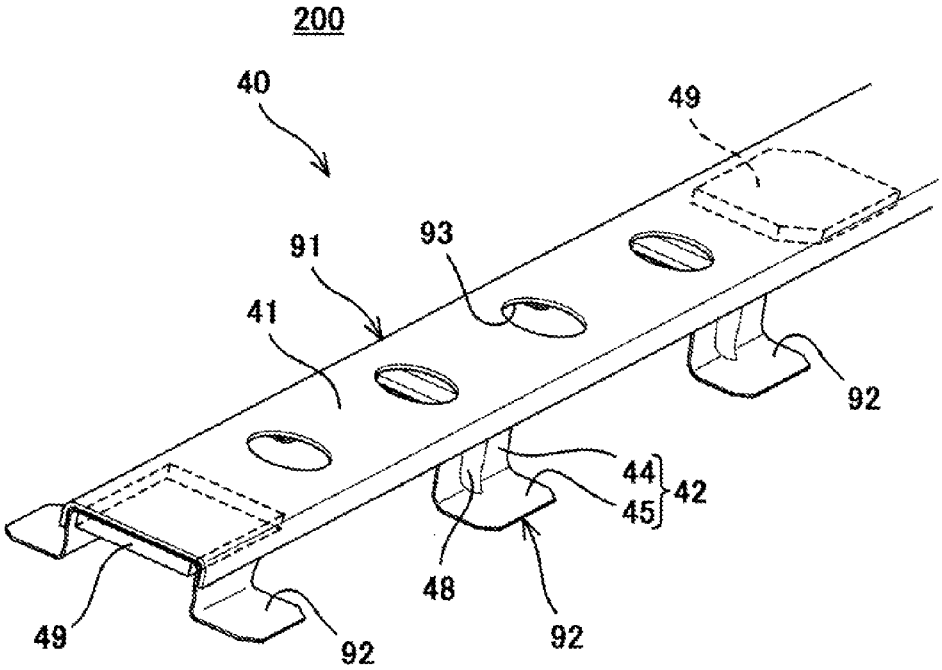
FIG. 5 is a partially enlarged view of the supporting member shown in FIG. 4.

Next, a railcar 200 according to Embodiment 2 will be explained in reference to FIGS. 4 to 7. The railcar 200 according to the present embodiment is different from the railcar 100 according to Embodiment 1 regarding the configuration of the receiving member 40. Other than the above, the railcar 200 according to the present embodiment is basically the same as the railcar 100 according to Embodiment 1. The following will mainly explain the receiving member 40 of the present embodiment. FIG. 4 is a perspective view of the receiving member 40 according to the present embodiment. FIG. 5 is enlarged it showing the vicinity of the railcar-width-direction end portion of the receiving member 40. A right near side on the sheet of each of FIGS. 4 and 5 is referred to as the front, side in the railcar longitudinal direction, and a left far side on the sheet of each of FIGS. 4 and 5 is referred to as the rear side in the railcar longitudinal direction. As shown in FIGS. 4 and 5, the receiving member 40 is mainly constituted by a floor plate contact member (floor plate contact portion) 91 and a plurality of leg members 92.

The floor plate contact member 91 of the receiving member 40 is a member including the floor plate contact surface 41 that contacts the floor plate 70. The floor plate contact member 91 extends in the railcar width direction and has an inverted U-shaped crass section. Weight reduction holes 93 are formed on the floor plate contact member 91 at regular intervals for weight reduction. The weight reduction holes 93 are formed so as to respectively correspond 10 the bottom surface portions 31 of the corrugated plate 30. As a result, the below-described leg members 92 are respectively located under the weight reduction holes 93. Plate-shaped screw seats 49 are attached to a lower surface of the floor plate contact member 91 at predetermined intervals. The floor plate 70 is fixed to the floor plate contact member 91 by fixing screws (not shown), and the screw seats 49 are used to attach the fixing screws. The floor plate contact member 91 is formed by processing a plate-shaped member, and the thickness thereof is such a thickness that has an adequate strength for supporting the floor plate 70. As one example, the thickness of the floor plate contact member 91 is about 1.5 mm.

Figure 6:
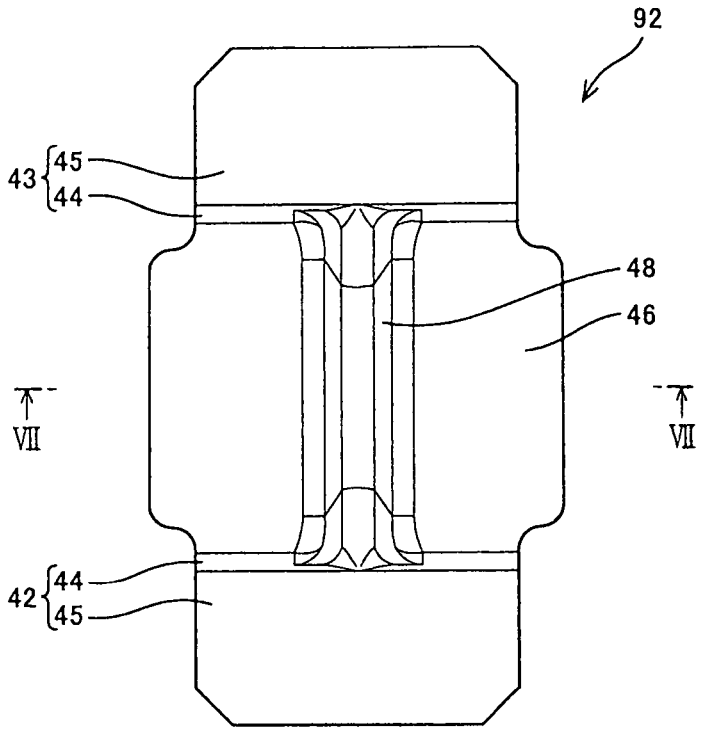
FIG. 6 is a plan view of a leg member shown in FIG. 5.
Figure 7:
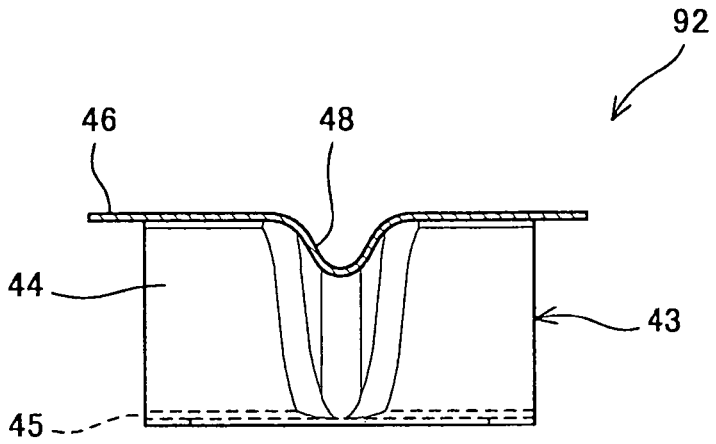
FIG. 7 is a cross-sectional view taken along line VII-VII of FIG. 6.

The leg members 92 are members arranged at the lower surface side of the floor plate contact member 91. The leg members 92 are arranged so as to be lined up in the railcar width direction. FIG. 6 is a plan view of the leg member 92 and FIG. 7 is a cross-sectional view taken along line VII-VII of FIG. 6. All upper-lower direction on the sheet of FIG. 6 corresponds to the railcar longitudinal direction, and a left-right direction on the sheet of FIG. 6 corresponds to the railcar width direction. A lower side on the sheet of FIG. 6 corresponds to the front side in the railcar longitudinal direction, and an upper side on the sheet of FIG. 6 corresponds to the rear side in the railcar longitudinal direction. The leg member 92 includes: a front leg portion 42 located at the front side in the railcar longitudinal direction; a rear leg portion 43 located at the rear side in the railcar longitudinal direction; and a leg coupling member 46 that contacts the lower surface of the floor plate contact member 91 and couples the front leg portion 42 and the rear leg portion 43. Each of the front leg portion 42 and the rear leg portion 43 is mainly constituted by: a vertical leg portion 44 extending downward from the floor plate contact surface 41; and a corrugated plate contact portion 45 that extends from a lower end of the vertical leg portion 44 to an outer side in the railcar longitudinal direction and surface-contacts the bottom surface portion 31 of the corrugated plate 30.

The leg member 92 is formed by a plate-shaped material, and the thickness thereof is smaller than that of the floor plate contact member 91. As one example, the thickness of the leg member 92 is about 0.8 mm. As above, since the thickness of the leg member 92 is smaller than that of the floor plate contact member 91, the strength of the floor plate contact member 91 can be maintained by increasing the thickness thereof and the thickness of the leg member 92 can be reduced. With this, the leg member 92 and the floor plate contact member 91 can be joined to each other by series spot welding or arc spot welding, so that work time can be shortened.

From the viewpoint of the weight reduction, it is preferable that the thickness of the leg member 92 be small. However, even the leg member 92 requires predetermined strength or more. Here, in the present embodiment, a bead 48 having a V-shaped cross section is formed on a width-direction middle portion of the surface of the leg member 92 so as to be depressed inward. In the present embodiment, as one example, the bead 48 is formed to extend from the front leg portion 42 through the leg coupling member 4 to the rear leg portion 43. By this bead 48, the strength of the leg member 92 with respect to force applied from an upper side can be improved. Since the head 48 is arranged at the width-direction middle portion as above, the spot welding or the like can be performed at both width-direction sides of the leg member 92. Therefore, the leg members 92 and the floor plate contact member 91 can be assembled in advance by the spot welding or the like, so that workability improves.

The above railcar includes: a pair of side sills extending in a railcar longitudinal direction; a plurality of cross beams extending in a railcar width direction and coupling the pair of side sills; a supporting member, which is arranged on upper surfaces of the cross beams, in which bottom surface portions and convex portions projecting upward from the bottom surface portions are alternately, continuously formed in the railcar width direction, and which extends in the railcar longitudinal direction; receiving members respectively located at positions corresponding to the cross beams, arranged on an upper surface of the supporting member, and extending in the railcar width direction; and a floor panel arranged on upper surfaces of the receiving members, wherein each of the receiving members includes: a floor plate contact portion that contacts the floor panel; and leg portions, each of which extends from the floor plate contact portion to the bottom surface portion of the supporting member.

According to this configuration, the receiving members that support passenger loads are provided on the supporting member located on upper surfaces of the cross beams, and the leg portions of the supporting members are respectively arranged at the bottom surface portions of the supporting member. Therefore, the adequate stiffness of the carbody can be secured by the simple configuration.

The above railcar may further include a heat absorbing layer and a heat dispersing layer, which are arranged on upper surfaces of the convex portions of the supporting member so as to be located between the receiving members adjacent to each other in the railcar longitudinal direction.

According to this configuration, since the heat absorbing layer and the heat dispersing layer are arranged above the cross beams, a heat resistant property and a heat insulation property can be efficiently obtained, and a thin type floor structure can be realized. With this, both the railcar inner space and the arrangement space for underfloor devices can be adequately secured.

The above railcar may be configured such that: each of the side sills includes an upper stage portion and a lower stage portion located lower than the upper stage portion, the upper stage portion and the lower stage portion being located at an upper surface side of the side sill; railcar-width-direction end portions of the floor panel are respectively placed on the upper stage portions of the side sills; and railcar-width-direction end portions of the supporting member are respectively placed on the lower stage portions of the side sills.

According to this configuration, the supporting, member can be arranged at a low position while maintaining the heights of upper sides of the side sills. Thus, the thin type floor structure can be realized. In addition, according to this configuration, the thickness of the heat absorbing layer and the thickness of the heat dispersing layer can be secured and the heights of the other beams, such as the bolster beam, which are required to have strength can be secured.

The above railcar may be configured such that railcar-width-direction end portions of each of the receiving members are respectively placed on the lower stage portions of the side sills.

In a case where the upper surfaces of the side sills are the same in height as the cross beams as in conventional sub-floor structures, the receiving members need to be additionally provided on the upper suffixes of the skit sills. However, according to the above configuration, the receiving members do not have to be newly provided.

The above railcar may be configured such that each of the leg portions of the receiving members includes a pair of first and second leg portions opposed to each other in the railcar longitudinal direction.

According to this configuration, since loads applied to the floor panel can be supported by the first leg portions and the second leg portions, the stiffness of the floor structure can be secured by the simple configuration.

The above railcar may be configured such that each of the leg portions of the receiving members further includes a leg coupling member that couples the first leg portion and the second leg portion and contacts a lower surface of the floor plate contact portion.

According to the above configuration, the strength of the floor plate contact member can be maintained or improved by increasing the thickness of the floor plate contact member, and the work time of the spot welding can be shortened by reducing the thickness of the leg member.

The above railcar may be configured such that a bead is formed on surfaces of the first and second leg portions.

According to the above configuration, the leg members of the receiving members can be reduced in thickness while maintaining the strength. Thus, the weight reduction can be realized. In addition, according to the above configuration, the bottom surface portions of the supporting member (or the cross beams) and the leg members can be welded to each other by series spot welding.

The foregoing has explained the embodiments in reference to the drawings. However, specific configurations are not limited to these embodiments. Design changes and the like within the scope of the present invention are included in the present invention. For example, the foregoing has explained a case where the stack member stacked on the upper side of the corrugated plate is constituted by the heat absorbing layer and the heat dispersing layer. However, even in a case where the stack member is constituted by adding a sound insulating layer to the heat absorbing layer and the heat dispersing layer (or by the sound insulating layer instead of the heat absorbing layer and the heat dispersing layer), this is included in the present invention.

Industrial Applicability

The railcar according to the present invention can secure the stillness thereof by a simple configuration. Therefore, the railcar according to the present invention is useful in the technical field of railcars.

REFERENCE SIGNS LIST

10 side sill
11 upper surface portion
14 upper stage portion
15 lower stage portion
20 cross beam
30 corrugated plate (supporting member)
31 bottom surface portion
32 convex portion
40 receiving member
42 front leg portion (first leg portion)
43 rear leg portion (second leg portion)
45 corrugated plate contact portion
47 floor plate contact portion
48 bead
51 stack member
90 floor panel
91 floor plate contact member (floor plate contact portion)
92 leg member
100, 200 railcar

The invention claimed is:

1. A floor structure of a railcar, the floor structure comprising:

a pair of side sills extending in a railcar longitudinal direction;

a plurality of cross beams extending in a railcar width direction and coupling the pair of side sills;

a supporting member, which is arranged on upper surfaces of the cross beams, in which bottom surface portions and convex portions projecting upward from the bottom surface portions are alternately, continuously formed in the railcar width direction, and which extends in the railcar longitudinal direction;

receiving members respectively located at positions corresponding to the cross beams, arranged on an upper surface of the supporting member, and extending in the railcar width direction; and a floor panel arranged on upper surfaces of the receiving members, wherein each of the receiving members includes: a floor plate contact portion that contacts the floor panel; and leg portions, each of which extends from the floor plate contact portion to the bottom surface portion of the supporting member.

2. The floor structure according to claim 1, further comprising a heat absorbing layer and a heat dispersing layer, which are arranged on upper surfaces of the convex portions of the supporting member so as to be located between the receiving members adjacent to each other in the railcar longitudinal direction.

3. The floor structure according to claim 1, wherein:

each of the side sills includes an upper stage portion and a lower stage portion located lower than the upper stage portion, the upper stage portion and the lower stage portion being located at an upper surface side of the side sill;

railcar-width-direction end portions of the floor panel are respectively placed on the upper stage portions of the side sills; and railcar-width-direction end portions of the supporting member are respectively placed on the lower stage portions of the side sills.

4. The floor structure according to claim 3, wherein railcar-width-direction end portions of each of the receiving members are respectively placed on the lower stage portions of the side sills.

5. The floor structure according to claim 1, wherein each of the leg portions of the receiving members includes a pair of first and second leg portions opposed to each other in the railcar longitudinal direction.

6. The floor structure according to claim 5, wherein:

each of the leg portions of the receiving members further includes a leg coupling member that couples the first leg portion and the second leg portion and contacts a lower surface of the floor plate contact portion; and each of a thickness of the first leg portion and the thickness of the second leg portion is smaller than the thickness of the floor plate contact portion.

7. The floor structure according to claim 5, wherein a bead is formed on surfaces of the first and second leg portions.

8. A railcar comprising the floor structure according to claim 1.

* * * * *